United States Patent [19]

Seegmiller

[11] Patent Number: 5,026,217

[45] Date of Patent: Jun. 25, 1991

[54] MINE ROOF SUPPORT TRUSS AND COMPONENTS

[76] Inventor: Ben L. Seegmiller, 143 S. 400 East, Salt Lake City, Utah 84111

[21] Appl. No.: 522,784

[22] Filed: May 14, 1990

[51] Int. Cl.[5] ..... E21D 21/00

[52] U.S. Cl. ..... 405/288; 405/259

[58] Field of Search ..... 405/259, 260, 261, 288

[56] References Cited

U.S. PATENT DOCUMENTS

| | | | |
|---|---|---|---|
| 4,596,496 | 6/1986 | Tyrell et al. | 405/288 |
| 4,679,967 | 7/1987 | Hipkins et al. | 405/288 |
| 4,749,310 | 6/1988 | White | 405/288 |
| 4,934,873 | 6/1990 | Calandra | 405/288 |

*Primary Examiner*—David H. Corbin

*Attorney, Agent, or Firm*—M. Ralph Shaffer

[57] ABSTRACT

A mine roof support truss and components thereof including support brackets and accommodating stirrups. In the truss construction, a pair of new type mine roof support brackets are utilized in combination with respective stirrups, the latter including interconnecting tie rod structure. The support brackets are unitary and preferably cast in construction, the same including the first portion having an upper bearing surface and a horn portion integral with and depending from such first portion. The horn portion is provided with a lower, upturned J-shaped lip which is useful for retaining a respective stirrup, which is designed to hang, when inactive, from the horn portion at the lip. During installation procedures, the stirrup associated with each horn portion of the respective brackets is elevated to horizontal position and the two stirrups tied together by tie rod means, with or without additional structure. The support brackets are secured in place against the exposed surface of a mine roof by means of anchor bolts, which are anchored into predrilled holes in the mine roof strata. The outer or rearward surfaces of the horn portion of the brackets are contoured to accommodate the U-configured end portions of the stirrups utilized.

12 Claims, 3 Drawing Sheets

MINE ROOF SUPPORT TRUSS AND COMPONENTS

FIELD OF INVENTION

The present invention relates to mine roof support truss and, more particularly, to trusses and components thereof, particularly support brackets, stirrups and the like, which are utilized in the construction of the overall truss structure so as to provide a tensioned truss disposed beneath and cooperating with roof strata of a mine roof.

BACKGROUND AND BRIEF DESCRIPTION OF PRIOR ART

In the past, a number of different types of trusses have been devised, which are useful for supporting and placing in compression mine roof strata. This is accomplished by tensioning the roof truss in an appropriate manner. The present invention takes the approach of providing a truss structure wherein the brackets may be of unitary one piece construction, generally cast, and wherein the support brackets each include, in effect a J-configured lip, respectively, for aiding in the transport and/or initial placement of respective connecting stirrups.

No art is known which teaches the concept of the present invention, and especially the concept of using unitary support brackets in combination with tie rod and stirrup structures. Especially is this the case wherein, as contrasted with the present invention, there is lack of provision in current structures for allowing the easy transport and initial placement of depending, vertically hanging stirrups. One U.S. Pat. No. 4,596,496, issued June 24, 1986, is known which teaches the incorporation in a truss of a U-bolt and the latter's cooperation with what is referred to as an angle block. The block in the patent, however, is separate from the bracket or plate engaging the bearing surface of the roof; furthermore, and most important, neither this patent or any other art with which the inventor is familiar, teaches the concept of having, in effect, a depending horn portion within a unitary bracket construction wherein the horn portion is supplied an upturned J-configured lip proximate the reaction surface of the horn for temporarily suspending in a hanging, inactive, vertical position, a stirrup carried thereby prior to the stirrup's erection to horizontal position for tensioning mode.

BRIEF DESCRIPTION OF PRESENT INVENTION

According to the present invention, a mine roof truss is provided and comprises a series of components including a pair of stirrups, a tie rod or other means for joining said stirrups in a tensioning manner, and roof support brackets, mutually spaced apart and coacting with the stirrups, the brackets being supplied customary roof bolts which are mounted into angulated apertures or holes in mine roof strata in a customary fashion.

In the present invention, the support brackets are of unitary or one-piece construction, generally will be cast, and will include a depending horn portion provided a curved upstanding J-configured lip. The purpose of the lip is to provide for easy mounting of a respective stirrup such that the user may transport the support bracket to a desired location in the mine without carrying the support bracket and stirrup in separate hands. Rather, the support bracket is used for transporting the stirrup automatically until the desired mine roof location is reached. At this point the support bracket is secured generally in place by employment of a roof bolt and accommodating nut; a similar procedure is followed relative to the remaining support bracket and its roof bolt and nut. Where both of the brackets carry their respective stirrups, the latter can be upwardly oriented in a horizontal configurement, a tie rod be disposed through the stirrups at the apertured portion of their respective end plates, and tensioning nuts supplied the opposite threaded ends of the tie rod or other tensioning structure. All of the nuts can be tightened so as to provide tension to the truss, generating a compression state in the roof strata thereabove.

The upturned lip or lip portion provided each of the horn portions of the support brackets provide not only for ease of transport of the necessary stirrups, but also act as a safety feature to keep the stirrups from becoming inadvertently disengaged with the support brackets so as to chance droppage and injury to personnel working there beneath.

OBJECTS

Accordingly, a principal object of the present invention is to provide a new and improved mine roof support truss.

A further object is to provide a mine roof support truss including unitary one piece brackets, tie rod means, and stirrups interconnecting the tie rod means with horn portions of the brackets.

An additional object is to provide a mine truss wherein the support brackets thereof are provided with accommodating reaction surfaces for stirrups used in the truss construction, and as well, safety hooks or upturned lips which can serve for initially transporting stirrups to a desired mine location as well as offering a safety feature once the desired location is reached, and e.g. to preclude inadvertent disengagement of the stirrup from its respective support bracket which might produce injury to personnel.

A further object is to provide an improved support bracket for mine roof truss structures.

An additional object is to provide a combination stirrup and mine roof support bracket of desired design for incorporation in a mine roof support truss.

BRIEF DESCRIPTION OF DRAWINGS

The present invention, together with further objects and advantages thereof, may best be understood by reference to the following description, taken in conjunction with the following drawings in which.

DETAILED DESCRIPTION OF PREFERRED EMBODIMENTS

Figure 1:
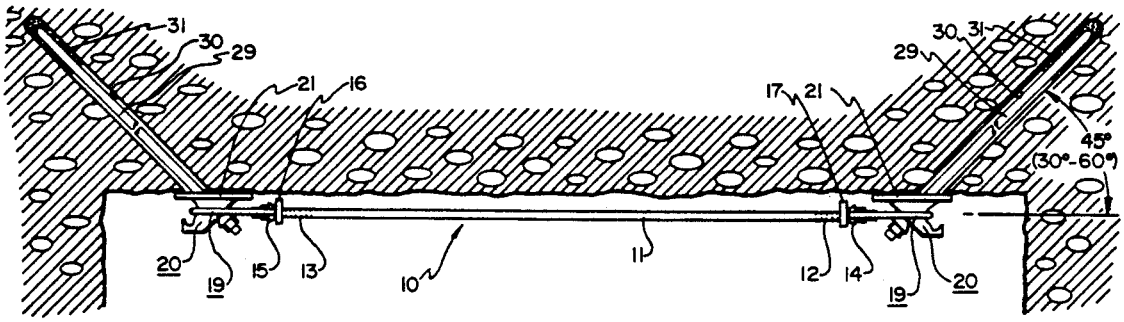
FIG. 1 is a front elevation of a mine roof truss, shown installed, and constructed in accordance with the principles of the present invention.
Figure 2:
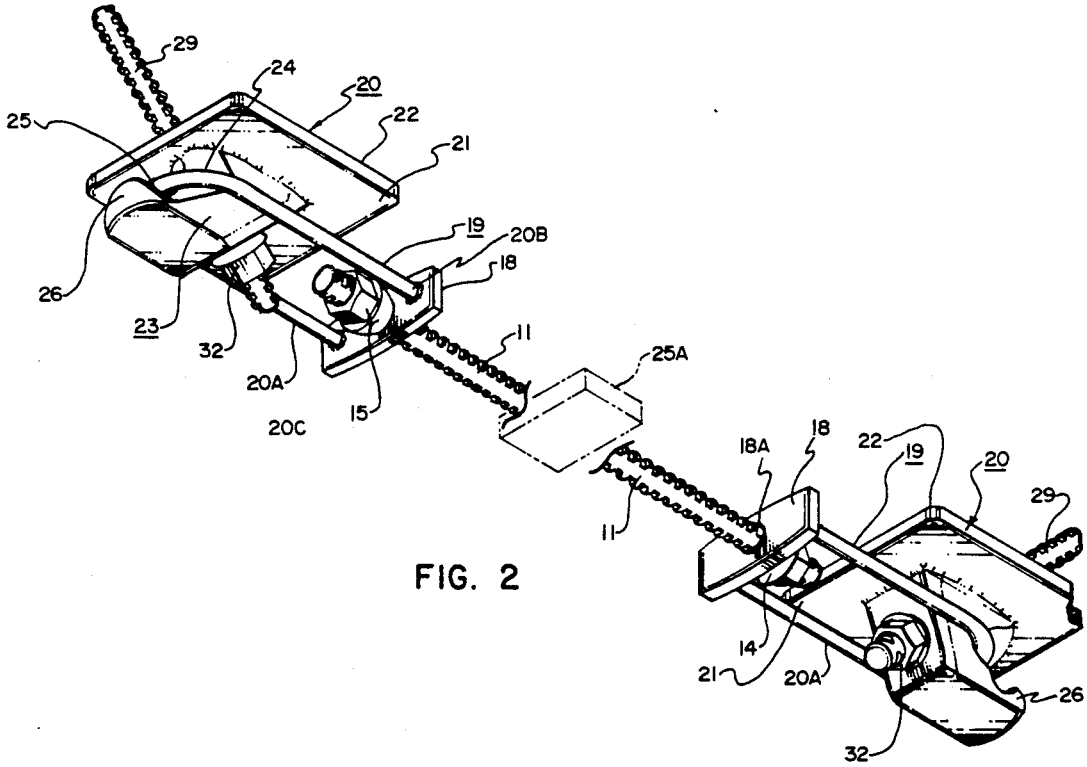
FIG. 2 is an enlarged perspective view of the truss of FIG. 1, a central portion thereof being shown schematically in phantom lines to indicate any one of a number of different types of tie rod configurements with associated structure.

In FIGS. 1 and 2 mine roof truss 10 includes, by way of example, a tie rod 11, having threaded ends 12 and 13, which receive securement nuts 14 and 15. The ends of the tie rod are secured, as will be seen, to additional member or end plates 16 and 17 in FIG. 1 of respective stirrups 19. These stirrups form part of the truss 10 as do also the support brackets 20 which they engage. Each mine roof support bracket 20 includes a first portion 21 provided an upper bearing surface 22. Integrally related with and depending from first portion 21 is a horn portion 23, shaped similarly, by way of example, to a saddle horn. In any event, horn portion 23 includes a convex, curved reaction surface 24 which is continuous with reaction surface portion 25 of an integral, raised, J-shaped lip 26.

In FIG. 2, each of the stirrups 19 is shown to include a representative U-shaped stirrup portion 20A, having ends 20B and 20C which are welded or otherwise secured to respective formed end plates 18 corresponding to plates 16, 17 in FIG. 1. Each of the end plates of the respective stirrups 19 will be provided with an enlarged aperture 18A for receiving tie rod means 11. Tie rod means 11, merely by way of example, may be unitary as a single tie rod 11 or form separate tie rods in a trussing system having an intermediate connecting subsystem 25A that may be of any desired form and form a part of any one of a variety of trussing systems. Suffice it to say, the tightening of self-aligning nuts 14 and 15 effects a drawing together of the stirrups so as to place in tension tie rod 11, the two stirrups 19, and also the support brackets 20 with which they are operably associated.

Figure 3:
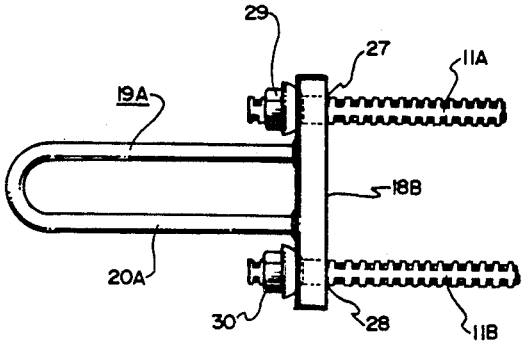
FIG. 3 is a plan view of an alternate stirrup that can be employed in the invention in lieu of those shown in FIG. 2.

FIG. 3 illustrates an alternate stirrup 19A which includes the same U-shaped stirrup member 20A, but the latter now having welded to its ends an end plate 18B provided with apertures 27 and 28. These latter apertures accommodate tie rods 11A and 11B with their respective self-aligning nuts 29 and 30. Accordingly, FIG. 3 illustrates that rather than the end plates simply accommodating a single tie rod 11 as in FIG. 2, a pair of parallel, mutually transversely spaced tie rods can be accommodated for joining together opposite stirrups relative to the truss. Of course the stirrup 19A may be enlarged as to width such that the apertures 27 and 28, with their associated tie rods 11A and 11B, can be disposed between the opposite legs of stirrup portion 28.

Figure 4:
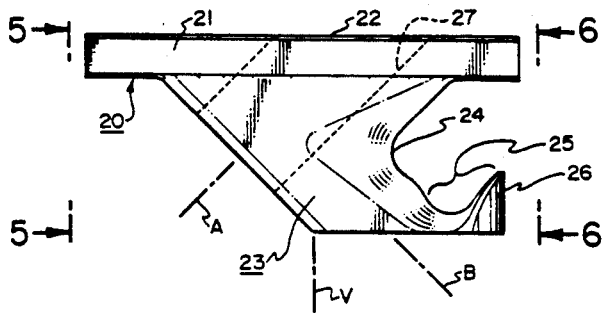
FIG. 4 is a side elevation of a mine roof support bracket employed in the truss of FIGS. 1 and 2.
Figure 5:
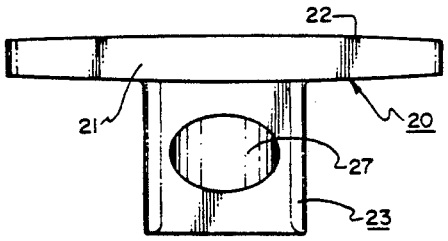
FIG. 5 is a left end view of the support bracket of FIG. 4 and is taken along the line 5—5 in FIG. 4.
Figure 6:
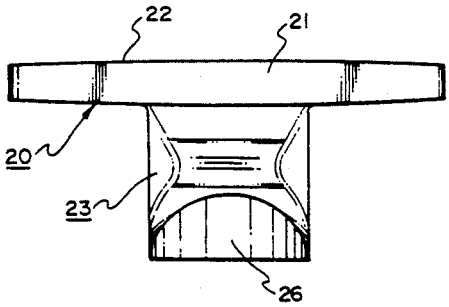
FIG. 6 is an end elevation of the right end of the support bracket of FIG. 4 and is taken along the line 6—6 in FIG. 4.
Figure 7:
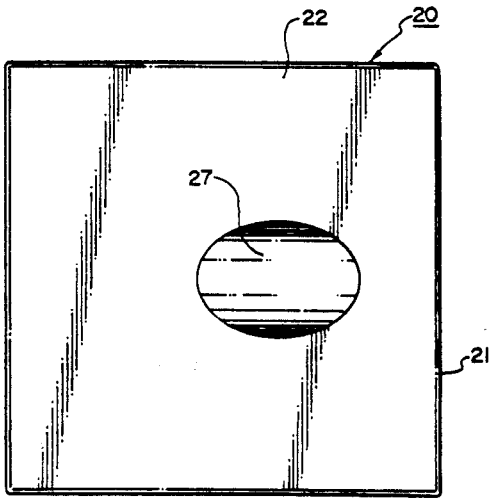
FIG. 7 is a top plan of the support bracket of FIG. 4.
Figure 8:
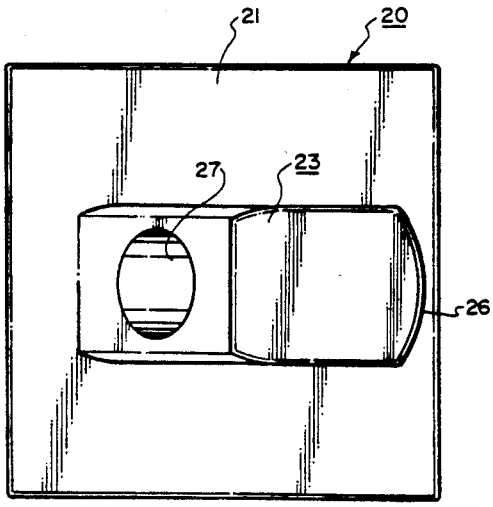
FIG. 8 is a bottom view of a support structure of FIG. 4.
Figure 11:
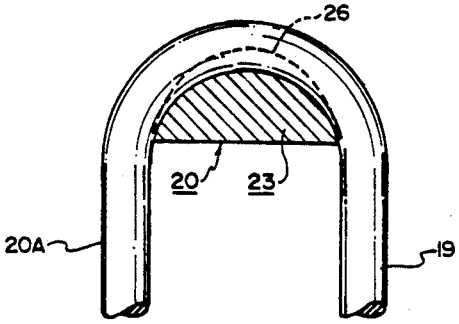
FIG. 11 a fragmentary view taken along the line 11—11 in FIG. 9, illustrating the stirrup as simply hanging from the raised lip of the horn portion of the bracket.

FIG. 4 illustrates a side elevation of a typical support bracket 20 and particularly the first portion 21 from which horn portion 23 depends. It will be noted that the rear or outside reaction surface 24 of horn portion 23 is curved and contoured to receive and retain, essentially in horizontal position, the stirrup such as stirrup 19 in FIG. 2. Of special importance is that the horn or horn portion includes a raised J-shaped lip 26, itself being provided with a reaction surface portion 25 contiguous with and cooperatively contoured relative to the reaction surface 24 of the horn portion. The raised lip is for the purpose of retentively containing and supporting in hanging vertical position a stirrup in the manner as seen in FIG. 11.

Figure 10:
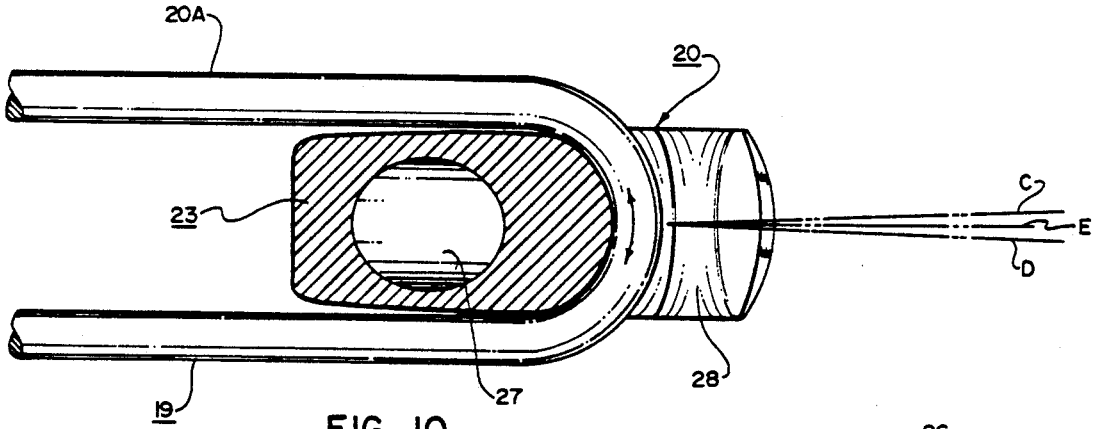
FIG. 10 is a section taken along the line 10—10 in FIG. 9, showing with more particularity the configurement of the horn and the stirrup and the adjustment feature relative thereto.

With the stirrup 19 elevated for operative position and for being placed in tension, then the structure as seen in FIG. 10 obtains.

The combination of first portion 21 and horn portion 23 are provided with a common, slanted or canted anchor bolt receiving aperture 27. The same includes axis A, see FIG. 4, which is canted relative to the axis B of the preferred orientation of horn portion 23. Various portions of the support bracket such as the first portion or plate 21 and the horn may be provided with suitable draft angles for convenience of the molding process. Thus, FIGS. 4–8 illustrate in detail the complete support bracket and the several configurations of its many portions. The raised J-shaped lip at 26 will of course include reaction surface portion 25 that is curved, is contiguous with, and aids stirrup retention in a connection with the presence of reaction surface 24.

In practice, see FIG. 10, the girth or separation between the legs of the stirrup can be somewhat wider than the width of the horn portion of the bracket, or at least the horn portion of the bracket will be contoured such that there can be a radial displacement adjustment of the stirrup to perhaps 10–20 degrees, see line C and D of FIG. 10 relative to the center line E. This allows for slight adjustments of the stirrup 19 relative to horn portion 23 as may be necessary for truss placement.

Figure 9:
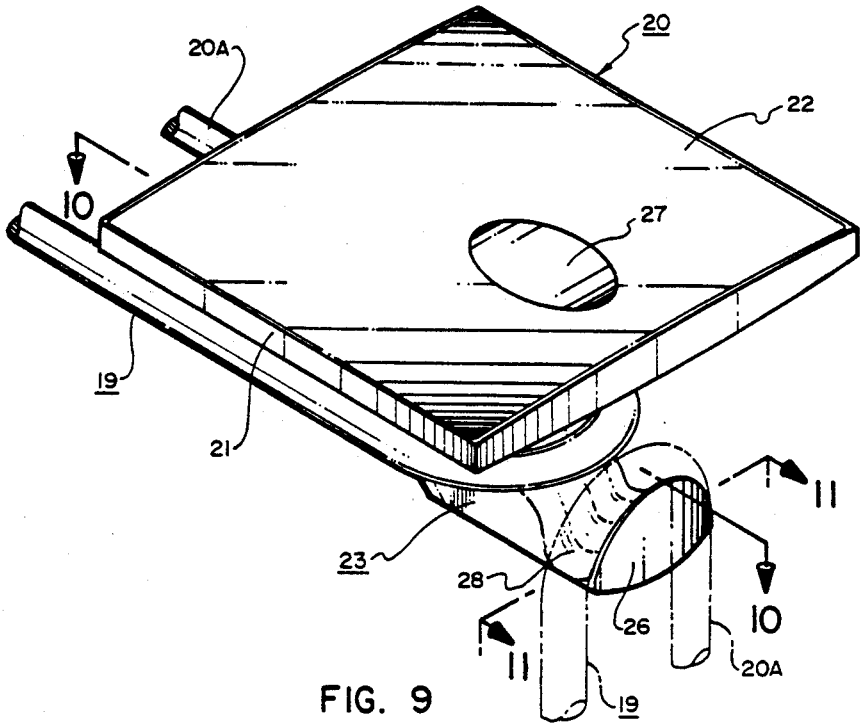
FIG. 9 is an enlarged perspective view of the support bracket of FIG. 4, illustrating the manner of engagement of the stirrup with the horn portion of the bracket when the stirrup, shown in solid lines, is disposed in horizontal position, the phantom lines indicating when the stirrup is in a vertical, inactive position.

FIG. 10 is of course a perspective view of a representative support bracket and its cooperation with and retention of a horizontally disposed stirrup that is ready for horizontal tensioning. This applies to both FIGS. 9 and 10. In the phantom line configurement in FIG. 9 and the solid line configurement in FIG. 11, it is illustrated that the lip 26 with its curved seat or reaction surface portion 25 aids in simply retaining the stirrup in a vertical hanging position for ease of transport; more important, the shape of the horn portion aids in preserving the integrity of the entire truss system even though substantial strata movement may occur.

In assembly and installation, see FIG. 1, anchor bolts 29 are positioned in predrilled holes 30 and the anchor bolts are secured by epoxy or other means in the holes at 31. Next, the two support brackets 20 are positioned over the anchor bolts 29 and self-aligning securement nuts 32 are threaded onto the ends of the anchor bolts and torqued to at least some degree so as to maintain the support brackets essentially in their desired position. It will be noted that at this time and prior thereto the upwardly turned lips of the support brackets at 26 are available for supporting the two stirrups that may be simply suspended therefrom.

The stirrups connected to the opposite brackets are then raised, the tie rod 11 is positioned and the self aligning nuts 14 and 15 tightened to bring the entire truss structure in tension. Final tightening of nuts 32 is accomplished and, finally, the tightening of nuts 14 and 15 complete the act of placing the entire truss structure in tension. The anchor bolt receiving aperture 27 of the respective brackets should be made sufficiently oversized relative to the diameter of the anchor bolt so that there can be rendered any adjustment considered necessary. The canted disposition of the anchor bolt receiving aperture 27, see axis A, may be varied to accommodate anchor bolt placements, nominally at 45 degrees but anywhere in the range between 30–60 degrees relative to the horizontal, see the right hand side of FIG. 1.

It is seen that the raised J-shaped lip of the horn portion of each bracket serves as a convenient mount for the stirrups when the same are in suspended vertical position, simply hanging from the horn portion of the respective brackets proximate the reaction surface portions 25 of the respective lips 26. The lip keeps the hanging stirrup from becoming decoupled and falling to the ground or on workmen. Once the support bracket is temporarily fixed in place, then the stirrup of course can be raised to accommodate the attachment of the tie rod 11 in the manner previously described.

The fact that the support bracket is unitary or one piece, and preferably cast, with suitable draft angles being employed, reduces the number of parts required; additionally, the safety feature and hanging accommodation of the stirrup by virtue of the raised lip becomes important. Again, the contour of the horn portion should be such that there can be slight alterations in orientation relative to the longitudinal axis of the stirrup and the longitudinal axis of the horn, see FIG. 10, whereby a variety of situations can be accommodated.

What is provided therefore is a new and improved mine roof support bracket, a bracket stirrup combination, and also a trussing structure for producing mine roofs.

I claim:

1. In combination, a mine roof support bracket for a truss and comprising a first portion having an upper bearing surface for engaging an exposed mine roof surface, and a horn portion part of and depending from said first portion, said horn portion having a rear reaction surface; an elongated U-shaped stirrup operatively horizontally disposed for the application of tension and engaging said reaction surface, said horn portion also being provided with a vertically raised, J-shaped lip means, forming an upwardly facing stirrup-support cradle, and disposed beneath and contiguous with said reaction surface for preserving truss integrity and supporting said stirrup when in a vertical hanging position in said cradle in non-tensioned condition, said vertically raised, J-shaped lip means being dimensioned to extend horizontally beyond said U-shaped stirrup for both operative-horizontal and vertical-hanging positions of said stirrup, the combination of said first portion and said horn portion being provided with an upwardly and outwardly canted aperture for receiving an external anchor bolt.

2. The structure of claim 1 wherein said support bracket comprises a one-piece cast part.

3. The structure of claim 1 wherein said horn portion is downwardly and outwardly canted relative to said first portion.

4. The structure of claim 1 wherein said reaction surface is horizontally convexly curved.

5. The structure of claim 1 wherein said lip means has a reaction surface portion contiguous with said reaction surface and is raised above said U-shaped stirrup when said stirrup is in a vertical, hanging position.

6. The structure of claim 1 wherein said horn portion has a forward abutment surface surrounding said aperture and constructed for engaging a retainer provided said external anchor bolt.

7. A mine roof truss including, in combination a pair of mutually spaced, aligned, integral, mine roof support brackets each comprising a first portion having an upper bearing surface for engaging an exposed mine roof surface, and a horn portion part of and depending from said first portion, said horn portion having a rear reaction surface cooperable with a U-shaped stirrup horizontally disposed for the application of tension, said horn portion also being provided with a vertically raised, J-shaped lip means, forming an upwardly facing stirrup-support cradle, and disposed beneath and contiguous with said reaction surface for aiding the maintenance of truss integrity and supporting said stirrup when in a vertical hanging position in non-tensioned condition, the combination of said first portion and said horn portion being provided with an upwardly and outwardly canted aperture for receiving an external anchor bolt; anchor bolts disposed in said apertures, respectively, of said support brackets and provided with nuts engaging said horn portions; and elongate means, including a pair of opposite U-shaped stirrups placed over said horn portions, for intercoupling said horn portions of both of said support brackets for tensioning said brackets toward each other, said vertically raised, J-shaped lip means of each of said support brackets being dimensioned to extend horizontally beyond its respective one of said U-shaped stirrup for both operative-horizontal and vertical-hanging positions of said stirrup.

8. The structure of claim 7 wherein said stirrups each include a U-shaped stirrup member having mutually spaced ends, an additional member secured to said ends, said plate having at least one tie-rod receiving aperture, said elongate means including tie rod means for securing said additional members of said stirrups together.

9. The structure of claim 7 wherein said rear surfaces of each of said horn portions are convexly curved and developed therebeneath through the contour of said lip means, whereby to accommodate truss integrity as well as vertical hanging positions of said stirrups and also horizontal active tensioned conditions thereof.

10. A mine roof truss including, in combination, a pair of mutually spaced mine roof support brackets of unitary construction, each of said support brackets having a depending horn portion provided with a rearwardly projecting raised stirrup-support lip; a pair of stirrups respectively mounted over said horn portions, each of said lips extending horizontally and rearwardly beyond respective ones of said stirrups; tensioning means intercoupling said stirrups for tensioning said brackets toward each other; and roof bolt means for securing said support brackets to a mine roof in mutually spaced relationship.

11. Structure according to claim 10 wherein each of said support brackets comprises a metallic cast part.

12. Structure according to claim 10 wherein said horn portions and stirrups are mutually constructed to accommodate flexibility in axial orientation of said stirrups relative to said horn portions.

* * * * *